US008292635B2

(12) United States Patent
Little et al.

(10) Patent No.: US 8,292,635 B2
(45) Date of Patent: Oct. 23, 2012

(54) CONNECTOR ASSEMBLY WITH ROBUST LATCHING MEANS

(75) Inventors: Terrance F. Little, York, PA (US); Chia-Pin Liu, New Taipei (TW); Ding-Cherng Chen, New Taipei (TW); Tzu-Ching Tsai, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/046,708

(22) Filed: Mar. 12, 2011

(65) Prior Publication Data

US 2012/0231648 A1 Sep. 13, 2012

(51) Int. Cl.
*H01R 12/00* (2006.01)

(52) U.S. Cl. ..... 439/74; 439/660; 439/570

(58) Field of Classification Search ..... 439/660, 439/74, 570

See application file for complete search history.

(56) References Cited

U.S. PATENT DOCUMENTS 7,845,958 B2 12/2010 Hoshino
2010/0221928 A1* 9/2010 Sato et al. ..... 439/74

* cited by examiner

*Primary Examiner* — Ross Gushi
(74) *Attorney, Agent, or Firm* — Wei Te Chung; Ming Chieh Chang

(57) ABSTRACT

A connector assembly (1000) includes a first connector (100) having a first insulative housing (11), a plurality of first terminals (12) supported by the first insulative housing and at least one latching member (13) combined with the first insulative housing, the latching member (13) having two locking arms (132) spaced apart from each other along a longitudinal direction; a second connector (200) having a second insulative housing (21), a plurality of second terminals (22) supported by the second insulative housing and at least one clasping member (23) combined with the second insulative housing, the clasping member (23) having a rigid longitudinal bar (232) with two free ends protruding at opposite directions; and wherein the rigid longitudinal bar is sandwiched between the two locking arms and the two free ends engaged with the two locking arms when the first connector mates with the second connector.

17 Claims, 22 Drawing Sheets

CONNECTOR ASSEMBLY WITH ROBUST LATCHING MEANS

BACKGROUND OF THE INVENTION

1. Field of the Invention

The present invention relates to a connector assembly, and more particularly to a connector assembly with latching means for holding two mated connectors together.

2. Description of Related Art

Conventionally, a connector having a plug connector mounted on a lower surface of a printed circuit board is fitted into a receptacle mounted on an upper surface of another printed circuit board to electrically connect the printed circuit boards has been known. For example, U.S. Pat. No. 7,845,958 issued on Dec. 7, 2010 to Hoshino et al. discloses a board-to-board connector assembly which includes a plug connector and receptacle connector can mating with each other and retained together by a latching device. The latching device includes a second support fitting is attached to both ends of a plug main body of the plug connector, and a first support fitting is attached to both ends of a socket main body of the receptacle connector. The second support fitting is engaged to the first support fitting.

However, as a connector assembly becomes lower profile, and the aforementioned latching device may be unable to provide sufficient latching force.

Hence, an improved connector assembly is required to overcome the problems of the prior art.

SUMMARY OF THE INVENTION

An object of the present invention is to provide a connector assembly with robust latching mechanism.

Accordingly, to achieve above-mentioned object, a connector assembly comprises a first connector including a first insulative housing, a plurality of first terminals supported by the first insulative housing and at least one latching member combined with the first insulative housing, the latching member having two locking arms spaced apart from each other along a longitudinal direction; a second connector including a second insulative housing, a plurality of second terminals supported by the second insulative housing and at least one clasping member combined with the second insulative housing, the clasping member having a rigid longitudinal bar with two free ends protruding at opposite directions; and wherein the rigid longitudinal bar is sandwiched between the two locking arms and the two free ends engaged with the two locking arms when the first connector mates with the second connector.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
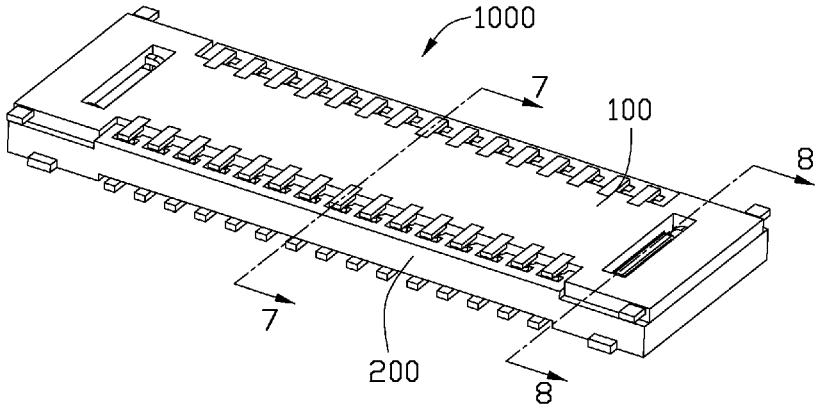
FIG. 1 is a perspective view of a connector assembly including a plug connector mating with the receptacle connector of a first embodiment in accordance with the present invention.
Figure 2:
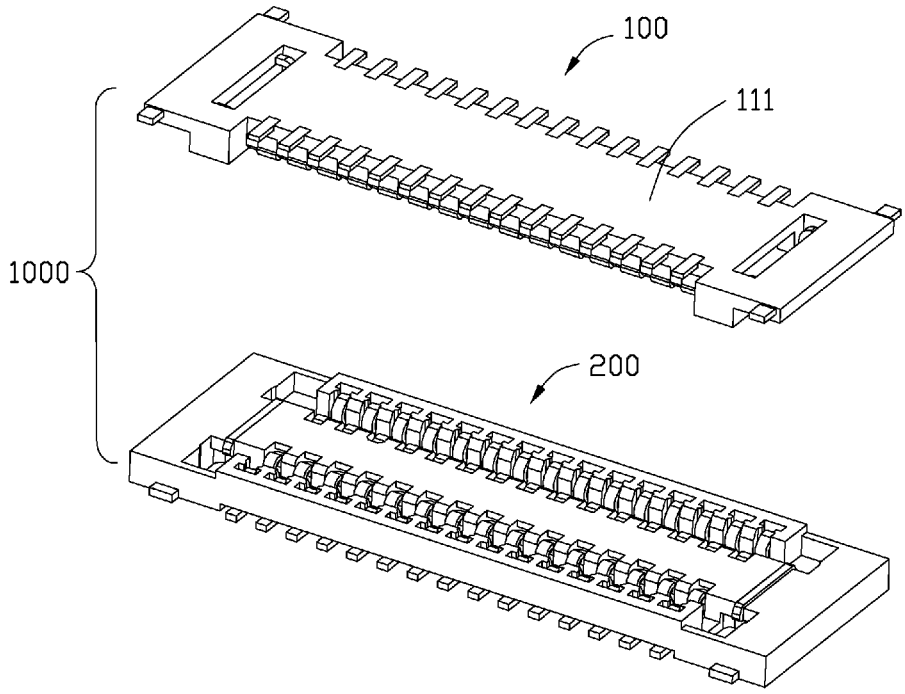
FIG. 2 shows the plug connector and the receptacle connector in unmated state.
Figure 3:
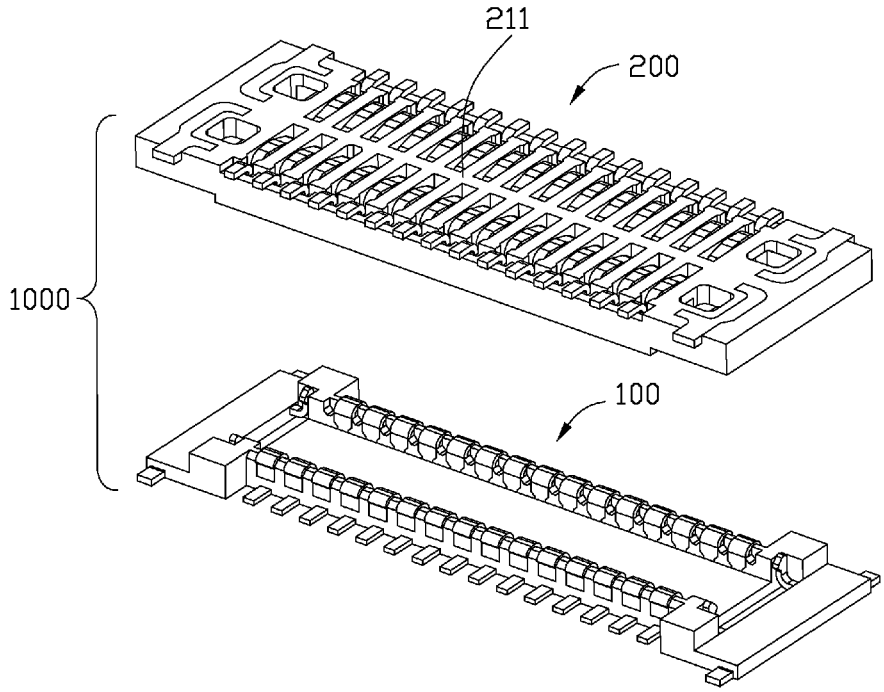
FIG. 3 is similar to FIG. 2, but viewed from other aspect.
Figure 4:
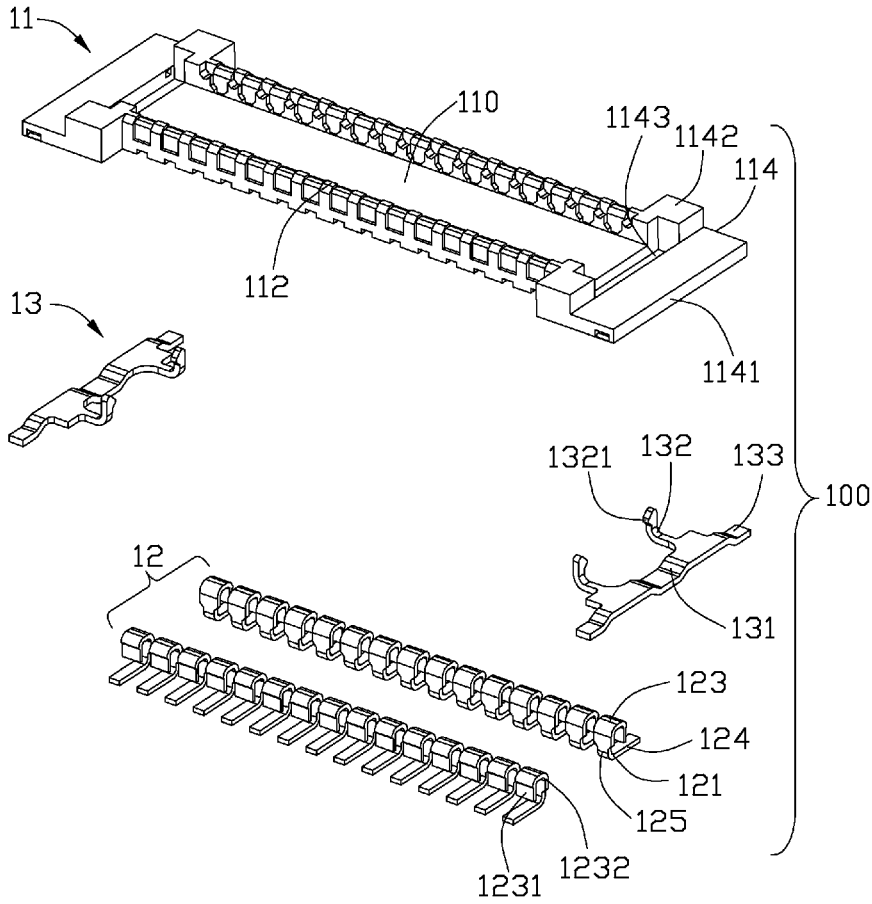
FIG. 4 is an exploded perspective view of the plug connector.
Figure 5:
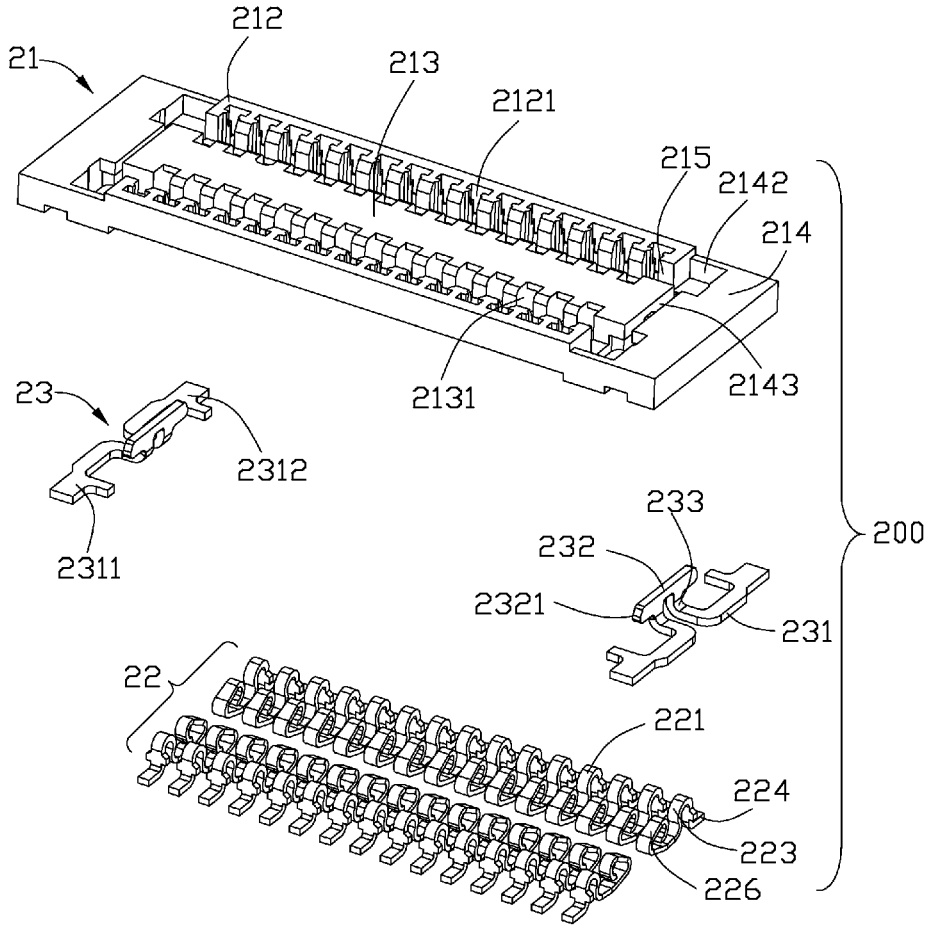
FIG. 5 is an exploded perspective view of the receptacle connector.
Figure 6:
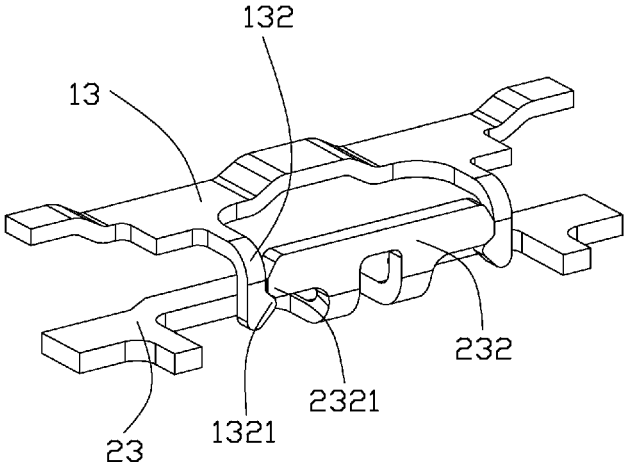
FIG. 6 illustrates a first type of latching member engaged with a first type of clasping member.
Figure 7:
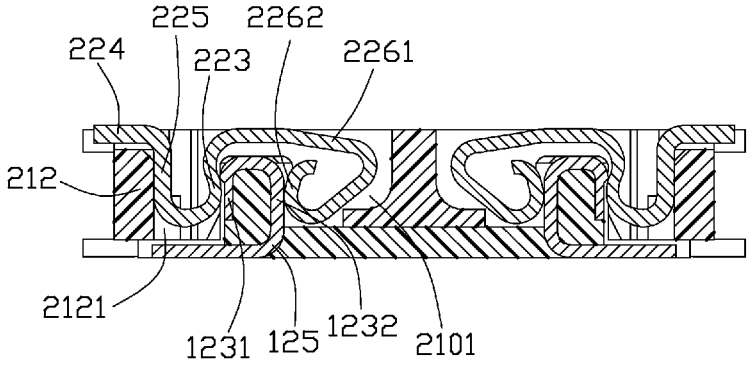
FIG. 7 is a cross-section view of FIG. 1 taken along line 7-7.
Figure 8:
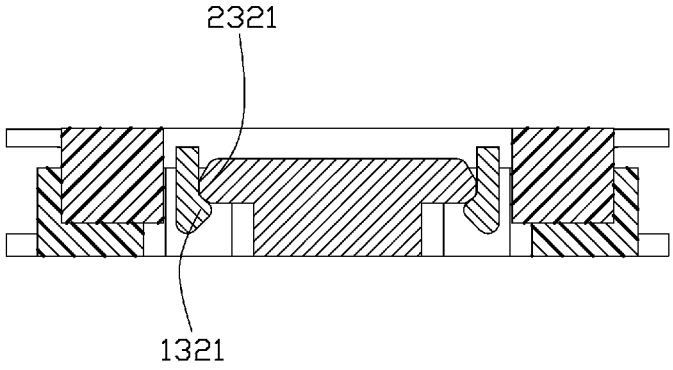
FIG. 8 is a cross-section view of FIG. 1 taken along line 8-8.

Referring to FIGS. 1-8, a connector assembly 1000 of a first embodiment in accordance with the present invention comprises a first connector/plug connector 100 and a second connector/receptacle connector 200 both adapted for mounting to corresponding printed circuit boards (not shown) respectively.

The first connector/plug connector 100 includes a first insulative housing 11, a plurality of first terminals 12 supported by the first insulative housing 11 and a pair of latching members 13 combined with the first insulative housing 11.

The first insulative housing 11 has a transversal base portion 111, two transversal walls 112 formed at a front edge and back edges of the transversal base portion 111 and two mounting portions 114 formed at a right and left sides of the transversal base portion 111. The two transversal walls 112 spaced from each other along a longitudinal direction, with a rectangular shaped receiving space 110 disposed therebetween. Each mounting portion 114 is of L-shaped viewed from a front or a back direction and includes a horizontal platform 1141 and two vertical protrusions 1142 supported by the horizontal platform 1141. In addition, there is a longitudinal slot 1143 defined on the horizontal platform 1141 and located between the two vertical protrusions 1142.

The first terminals 12 are separated into two distinct sets 121 both arranged in a transversal row and mounted to the two transversal walls 112. Each first terminal 12 has an inverted U-shaped mating portion 123, a horizontal tail portion 124 and an inclined retention portion 125 connected with the mating portion 123 and the tail portion 124. The mating portion 123 has a first mating part 1231 and a second mating part 1232 both extending along a vertical direction and parallel to each other. The first mating part 1231 has a free end projecting downwardly. The first terminals 12 are mounted to the insulative housing 11, with the mating portions 123 riding on the corresponding transversal wall 112 and the first mating part 1231 and second mating part 1232 disposed at opposite sides of the transversal wall 112; the tail portion 124 disposed below the base portion 111, and the retention portion 125 retained in the base portion 111.

The latching member 13 includes a main body 131 extending along a longitudinal direction, two L-shaped latching arms 132 inwardly projecting from the main body 131 firstly and then bent upwardly and two free ends 133 respectively formed at opposite ends of the main body 131. In addition, there is a hook 1321 formed at an end of each latching arm 132 and faces to each other along the longitudinal direction. The latching member 13 is inserted molded with the mounting portion 114 of the insulative housing 11, with the main body 131 enclosed within the platform 1141, the two free ends 133 exposed outside the platform 1141, and the latching arms 132 disposed in the longitudinal slot 1143 and located adjacent to the two protrusions 1142, respectively.

The second connector/receptacle connector 200 includes a second insulative housing 21, a plurality of second terminals 22 supported by the second insulative housing 21 and a pair of clasping members 23 combined with the second insulative housing 21.

The second insulative housing 21 has a transversal base portion 211, two transversal walls 212 formed at a front and back edges of the transversal base portion 211 and two mounting portions 214 formed at a right and left sides of the transversal base portion 211. The two transversal walls 212 spaced from each other along the longitudinal direction. In addition, there is a transversal beam 213 arranged between the two transversal walls 212, with two transversal slots 215 respectively arranged between the transversal beam 213 and two transversal walls 212. Each transversal wall 212 defines a plurality of first vertical grooves 2121 communicating with the corresponding transversal slot 215. There are a plurality of second vertical grooves 2131 respectively located in a front and back sides of the transversal beam 213 and communicate with the transversal slots 215, respectively. The first vertical grooves 2121 align with the second vertical grooves 2131 along a front-to-back direction. Each mounting portion 214 defines two cavities 2142 located in a front and back sections thereof and disposed adjacent to ends of the transversal walls 212. In addition, there is a longitudinal slot 2143 located in a middle segment of the mounting portion 214 and proximate to an end of the transversal beam 213. The longitudinal slot 2143 further communicates with the two cavities 2142.

The second terminals 22 are separated into two distinct sets 221 and mounted to the two transversal walls 212. Each second terminal 22 has a S-shaped first mating segment 223 and a horizontal tail segment 224 connected with each other by a vertical retention segment 225. The first mating segment 223 is accommodated in the first vertical groove 2121 and further extends into the transversal slot 215. The retention segment 225 is held in the first vertical groove 2121. The tail segment 224 disposed above the base portion 211. The second terminal 22 further has a curved second mating segment 226 connected to an upper end of the first mating segment 223 and accommodated in the second vertical grooves 2131. The second mating segment 226 has a heart shaped main body 2261 and an arc shaped distal end 2262 connected to a lower end of the main body 2261 and projecting inwardly. The arc shaped distal end 2262 also extends into the transversal slot 215 and faces to the first mating segment 223.

The clasping member 23 includes a main body 231 which includes two F-shaped anchors 2311, 2312 located at a horizontal plane and arranged in head-to-head manner, two L-shaped supporting arms 233 inwardly projecting from adjacent ends of the two anchors 2311, 2312 firstly and then bent upwardly, and a rigid longitudinal bar 232 located in a vertical plane and connected to the two supporting arms 233. The longitudinal bar 232 has two free ends 2321 protruding at opposite directions. The clasping member 23 is inserted molded with the mounting portion 214 of the second insulative housing 21, with the main body 231 enclosed within the mounting portion 214, the two free ends 2311, 2312 extending beyond a front and back edges of the mounting portion 214, and the transversal bar 232 disposed in the longitudinal slot 2143 and the two free ends 2321 respectively extend into the two cavities 2142.

The first connector 100 mates with the second connector 200, with the first mating part 1231 and second mating part 1232 respectively contacting with the first mating segment 223 and second mating segment 226. The latching member 13 locking with the clasping member 23, with the transversal bar 232 sandwiched between the two L-shaped arms 132 and the hooks 1321 engaging with the free end 2321. The two vertical protrusions 1142 are received in the two cavities 2142. Therefore, the first connector 100 and the second connector 200 can reliably engage with each other.

Figure 9:
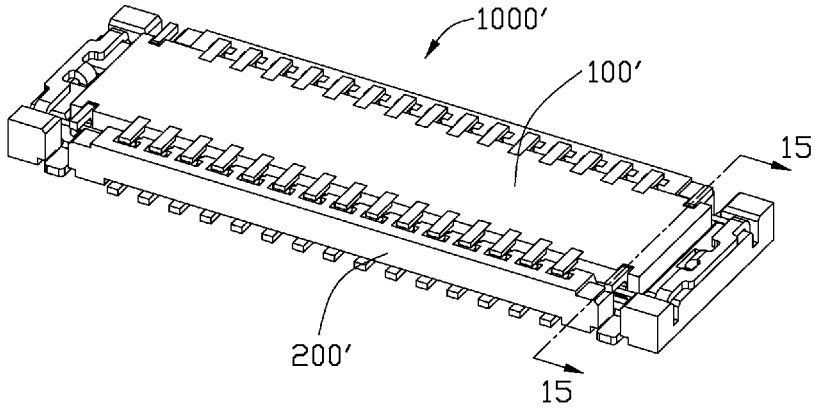
FIG. 9 is a perspective view of a connector assembly including a plug connector mating with the receptacle connector of a second embodiment in accordance with the present invention.
Figure 10:
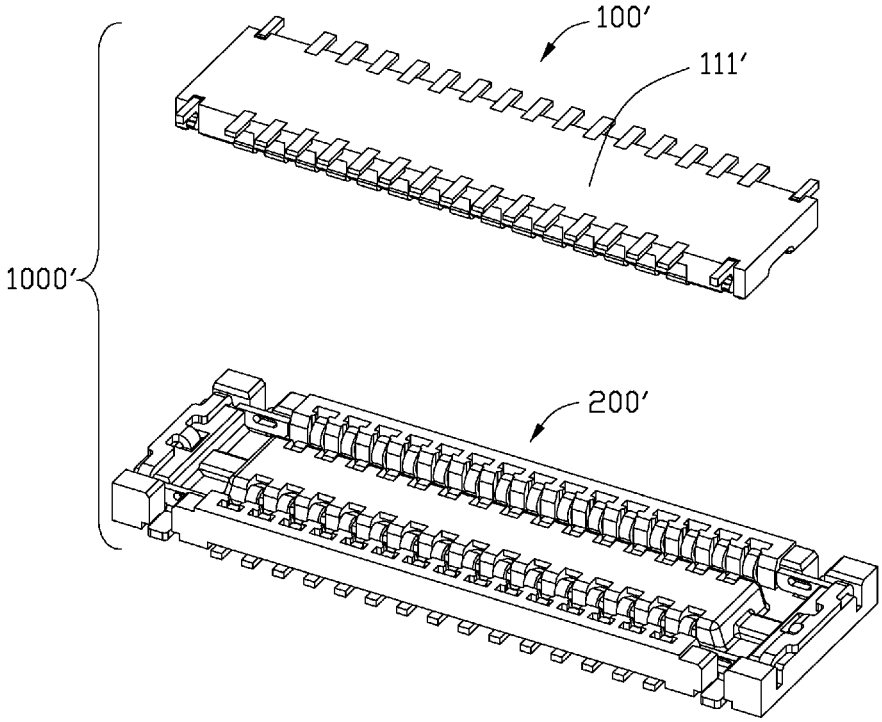
FIG. 10 shows the plug connector and the receptacle connector in unmated state.
Figure 11:
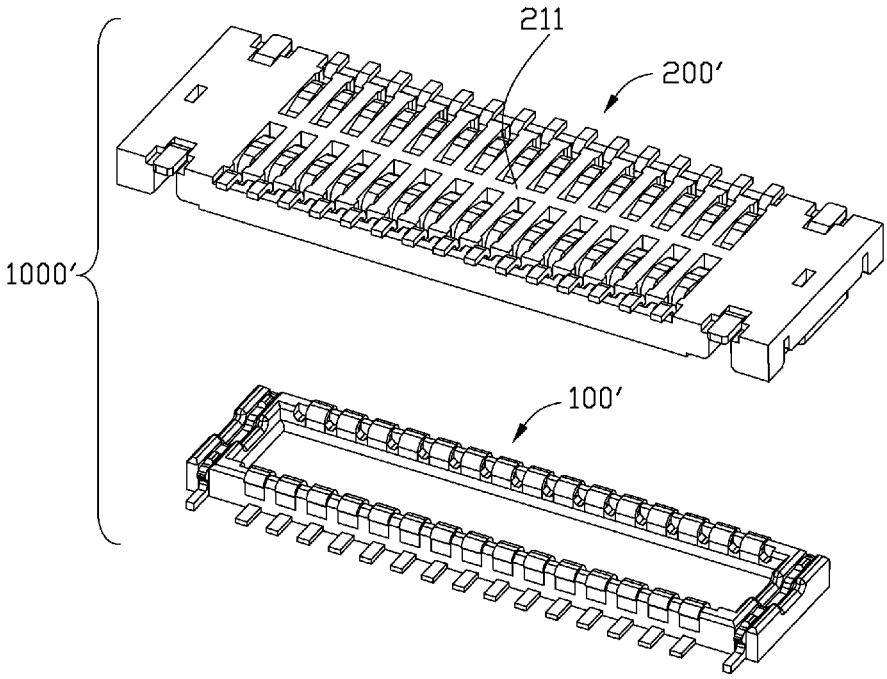
FIG. 11 is similar to FIG. 10, but viewed from other aspect.
Figure 12:
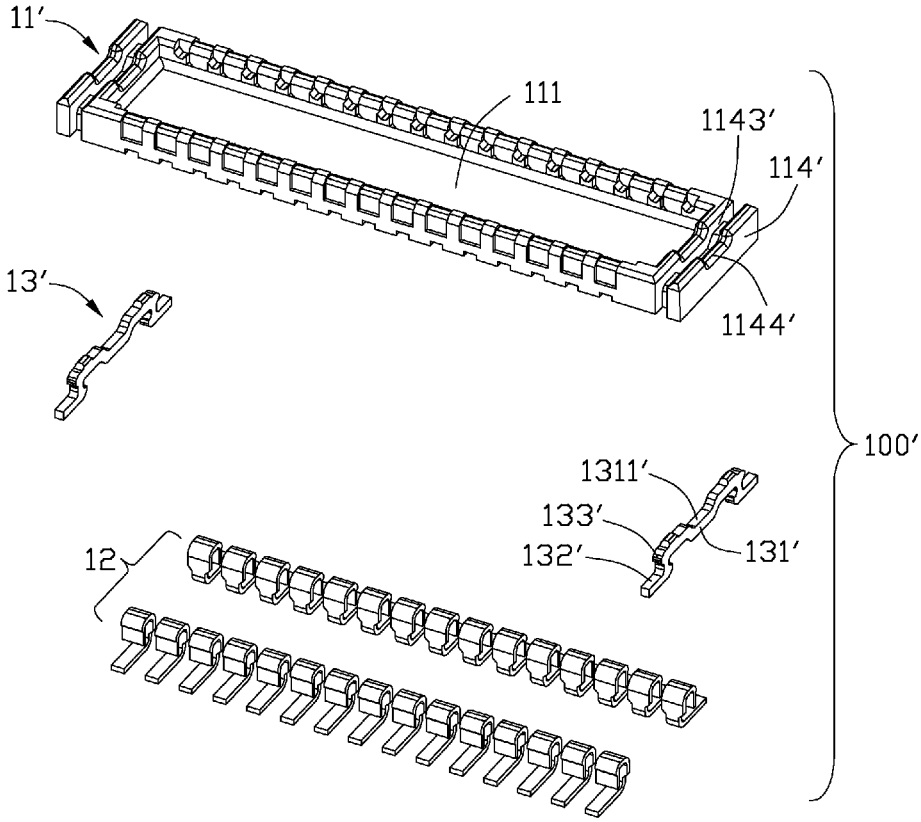
FIG. 12 is an exploded perspective view of the plug connector.
Figure 13:
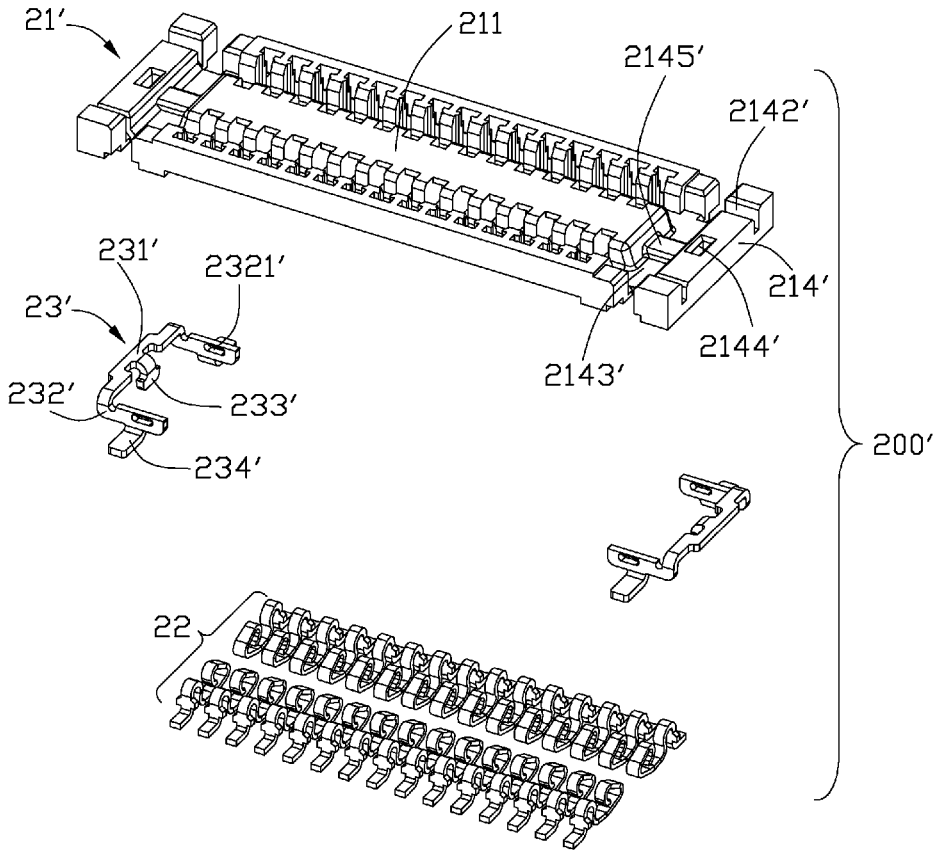
FIG. 13 is an exploded perspective view of the receptacle connector.
Figure 14:
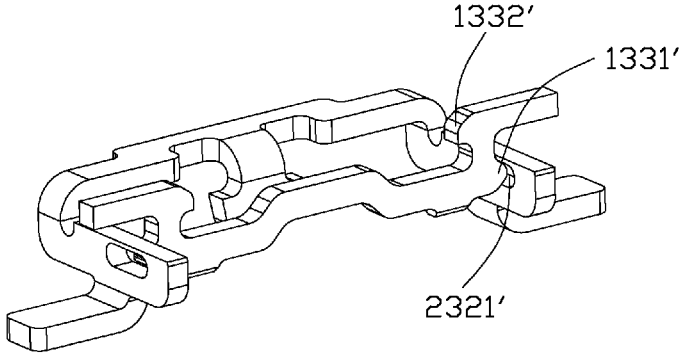
FIG. 14 illustrates a second type of latching member engaged with a second type of clasping member.
Figure 15:
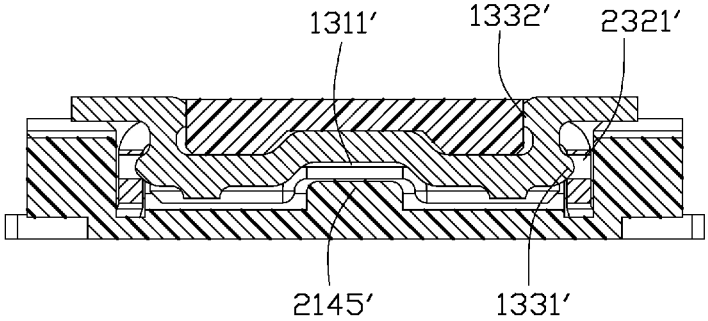
FIG. 15 is a cross-section view of FIG. 9 taken along line 15-15.

Referring to FIGS. 9-15, a connector assembly 1000' of a second embodiment in accordance with the present invention comprises a first connector/plug connector 100' and a second connector/receptacle connector 200' both adapted for mounting to corresponding printed circuit boards (not shown) respectively.

The first connector/plug connector 100' includes a first insulative housing 11', a plurality of first terminals 12 supported by the first insulative housing 11' and a pair of latching members 13' combined with the first insulative housing 11'.

The first insulative housing 11' is similar to the first insulative housing 11 of the first embodiment, excepted for two mounting portions 114'arranged at opposite sides of a transversal base portion 111 thereof. Each mounting portion 114' defines a longitudinal slot 1143' through a front and back sides of the mounting portion 114'. Further, there are two recesses 1144' located at a middle segment of a top side of the mounting portion 114'.

Each latching member 13' is of bowed shape and has a rigid longitudinal main body 131' and two horizontal feet 132' disposed below the main body 131' and extending along opposite directions and two Z-shaped connecting portions 133' respectively linking the main body 131' and the two horizontal feet 132'. There is a depression 1311' located at a middle segment of the main body 131'. Each of the two connecting portion 133' has a first protrusion 1331' and a second protrusion 1332' respectively located at different levels and projecting along opposite directions. The two first protrusion 1331' project at opposite directions, and the two second protrusions 1332' face to each other along the longitudinal direction. The latching member 13' is mounted to the mounting portion 114', with the main body 131' accommodated in the longitudinal slot 1143', the two horizontal feet 132' disposed at a front and back sides of the mounting portion 114'. The first protrusions 1331' disposed outside the front and back sides of the mounting portion 114', and the second protrusions 1332' snapped into the mounting portion 114'.

The second connector/receptacle connector 200' includes a second insulative housing 21', a plurality of second terminals 22 supported by the second insulative housing 21' and a pair of clasping members 23' combined with the second insulative housing 21'.

The second insulative housing 21' is similar to the second insulative housing 21 of the first embodiment, excepted for two mounting portions 214' arranged at opposite sides of a transversal base portion 211 thereof. Each mounting portion 214' defines a longitudinal slot 2143' through a front and back sides of the mounting portion 214'. Further, there are two transversal passages 2142' located at a front and back sections of the mounting portion 214' and communicate with the longitudinal slot 2143'. In addition, there is a positioning hole 2144' defined in a middle section of the mounting portion 214'. Furthermore, there is key 2145' disposed at central of a bottom side of the longitudinal slot 2143'.

Each clasping member 23' has a main body 231' located at a horizontal plane and two L-shaped locking arms 232' connected to opposite ends of the main body 231' and located in two vertical planes, and two feet 234' extending from bottom edges of the two L-shaped locking arms 232' and along opposite directions. There is positioning tab 233' bent downwardly from middle section of the main body 231' and disposed between the two locking arms 232'. Furthermore, there is a transversal hole 2321' defined in a front section of the locking arm 232'. The clasping member 23' is assembled to the mounting portion 214', with the main body 213' supported by the mounting portion 214', the positioning tab 233'interferentially combined with the positioning hole 2144', back segments of the two locking arms 232' received in the two transversal passages 2142', front segments of the two locking arms 232' extending into the longitudinal slot 2143', and the two feet 234' exposed outward of the mounting portion 214'.

When the first connector 100' mates with the second connector 200', the latching member 13' locking with the clasping member 23', with the main body 131' sandwiched between the two locking arms 232', the first protrusion 1331' of the connecting portion 133' pressed fit with the transversal hole 2321' of the corresponding locking arm 232'. In addition, the depression 1311' aligns with the key 2145'.

Figure 16:
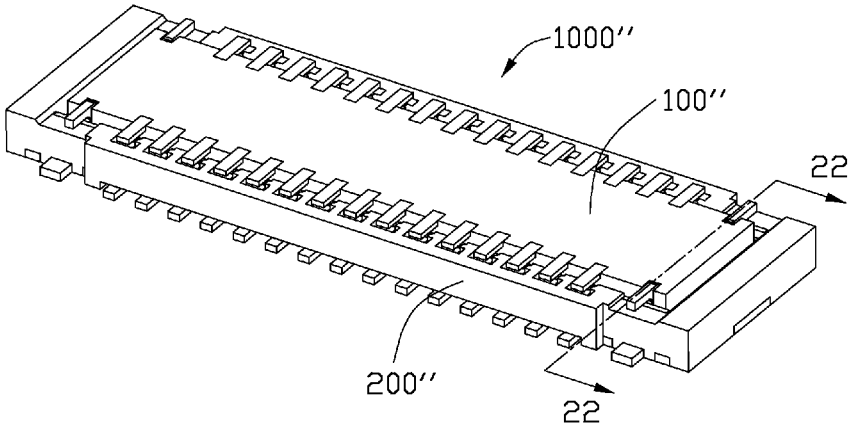
FIG. 16 is a perspective view of a connector assembly includes a plug connector mating with the receptacle connector of a third embodiment in accordance with the present invention.
Figure 17:
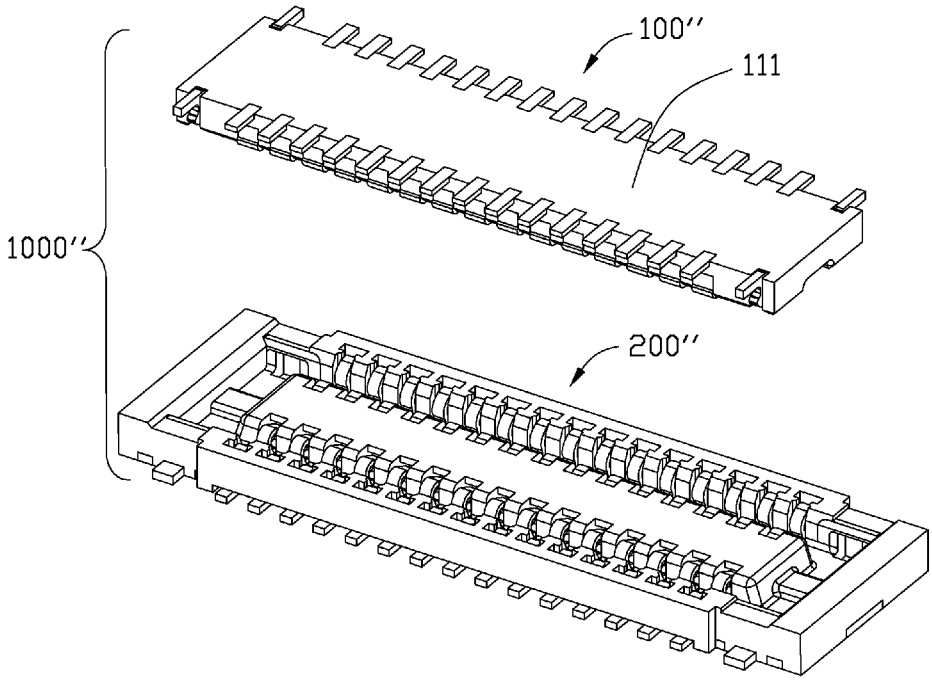
FIG. 17 shows the plug connector and the receptacle connector in unmated state.
Figure 18:
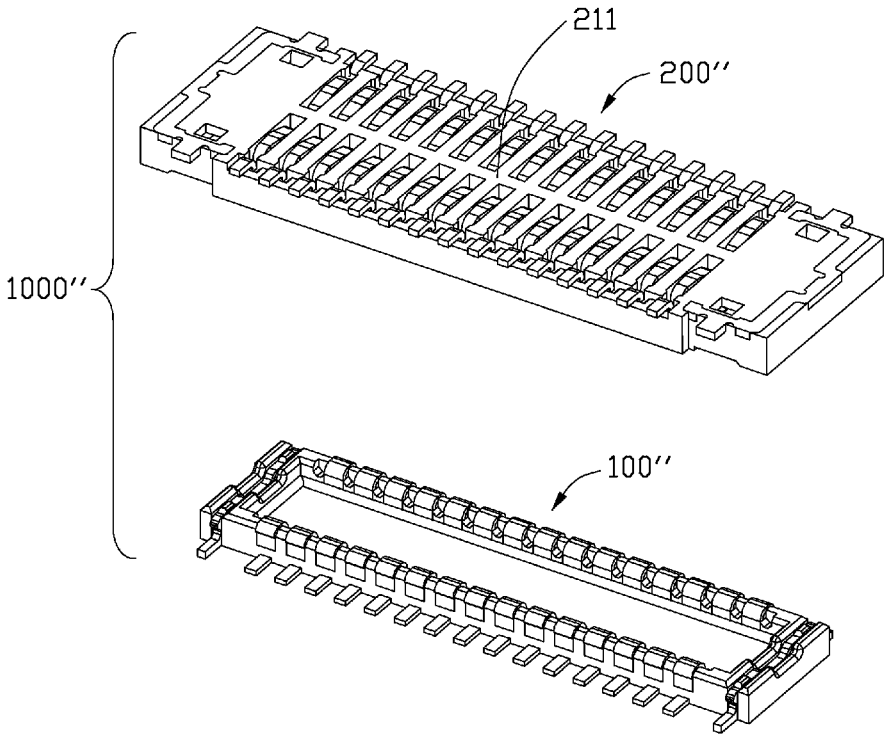
FIG. 18 is similar to FIG. 17, but viewed from other aspect.
Figure 19:
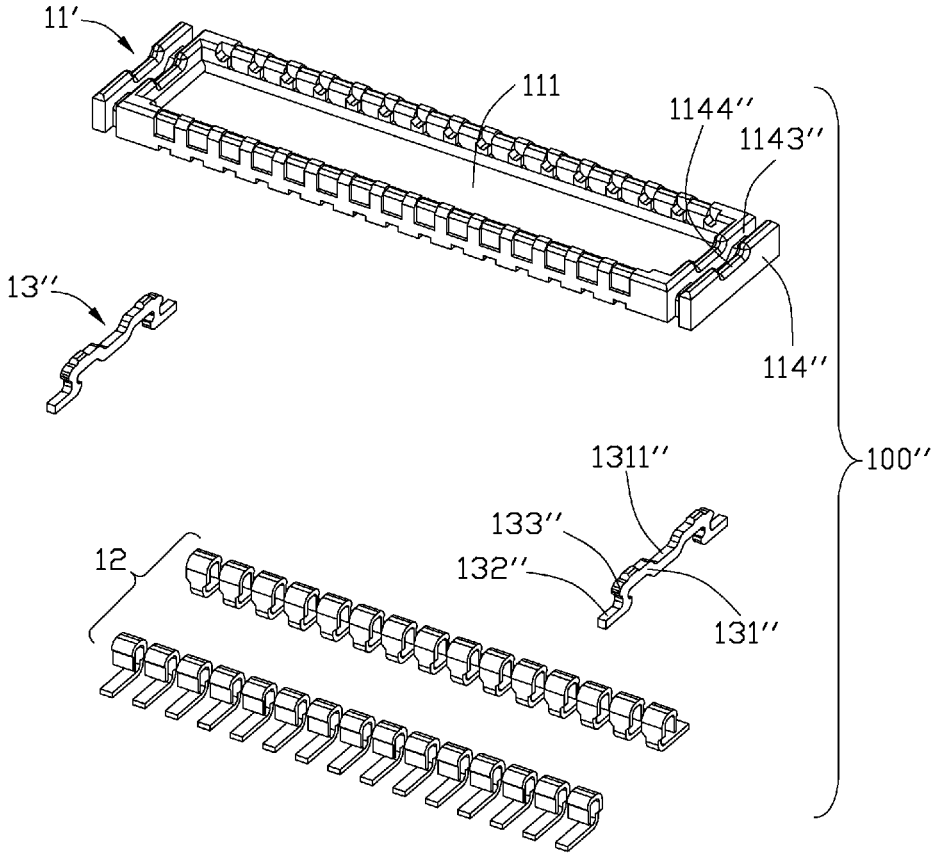
FIG. 19 is an exploded perspective view of the plug connector.
Figure 20:
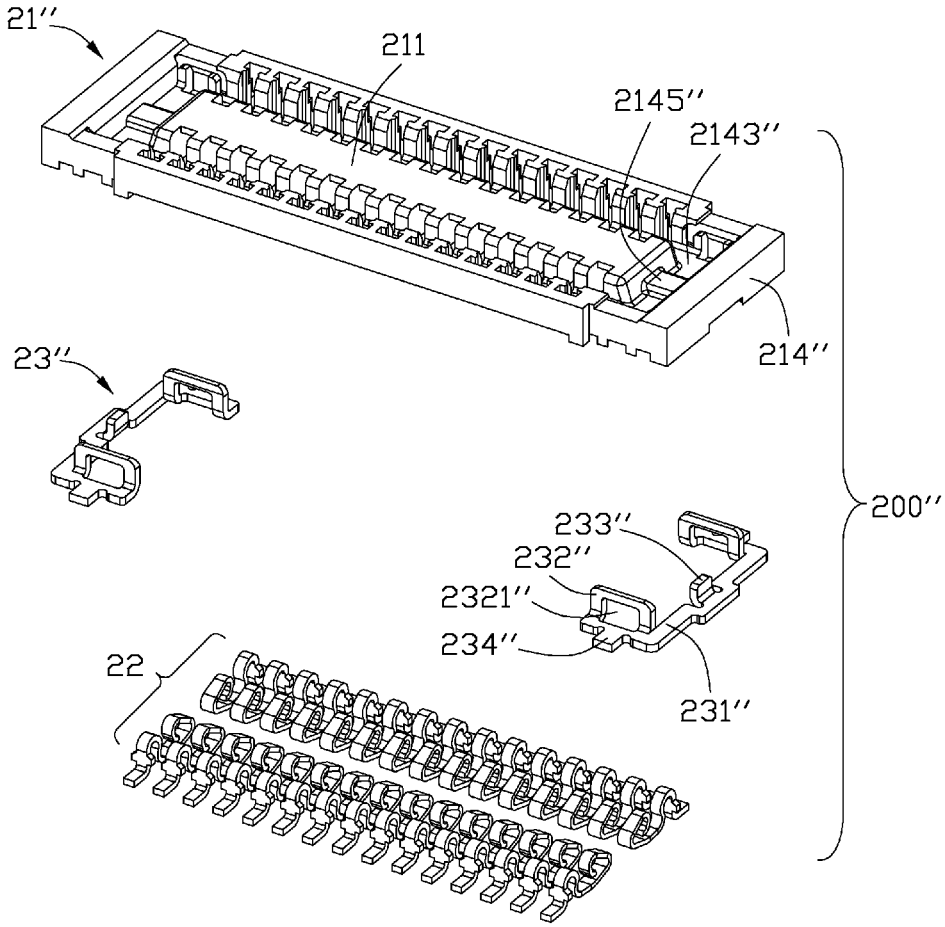
FIG. 20 is an exploded perspective view of the receptacle connector.
Figure 21:
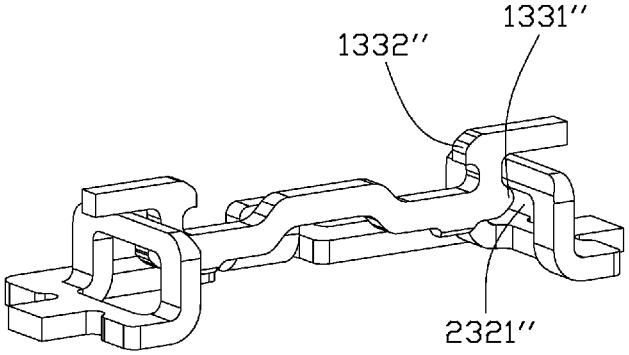
FIG. 21 illustrates a third type of latching member engaged with a third type of clasping member.
Figure 22:
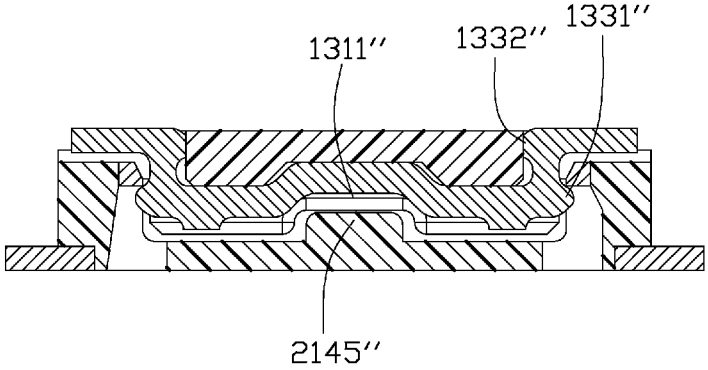
FIG. 22 is a cross-section view of FIG. 16 taken along line 22-22.

Referring to FIGS. 16-22, a connector assembly 1000" of a third embodiment in accordance with the present invention comprises a first connector/plug connector 100" and a second connector/receptacle connector 200" both adapted for mounting to corresponding printed circuit boards (not shown) respectively.

The first connector/plug connector 100" includes a first insulative housing 11", a plurality of first terminals 12 supported by the first insulative housing 11" and a pair of latching members 13" combined with the first insulative housing 11".

The first insulative housing 11" is similar to the first insulative housing 11 of the first embodiment, excepted for two mounting portions 114" arranged at opposite sides of a transversal base portion 111 thereof. Each mounting portion 114" defines a longitudinal slot 1143" through a front and back sides of the mounting portion 114". Further, there are two recesses 1144" located at a middle segment of a top side of the mounting portion 114".

Each latching member 13" is of bowed shape and has a rigid longitudinal main body 131" and two horizontal feet 132" disposed below the main body 131" and extending along an opposite direction and two Z-shaped connecting portions 133" respectively linking the main body 131" and the two horizontal feet 132". There is a depression 1311" located in a middle segment of the main body 131". The connecting portion 133" has a first protrusion 1331" and a second protrusion 1332". The latching member 13" is mounted to the mounting portion 114", with the main body 131" accommodated in the longitudinal slot 1143", the two horizontal feet 132" disposed outward a front and back sides of the mounting portion 114". The first protrusions 1331" are exposed outward the front and back sides of the mounting portion 114", and the second protrusions 1332" snapped into the mounting portion 114".

The second connector/receptacle connector 200" includes a second insulative housing 21", a plurality of second terminals 22 supported by the second insulative housing 21" and a pair of clasping members 23" combined with the second insulative housing 21".

The second insulative housing 21" is similar to the second insulative housing 21 of the first embodiment, excepted for two mounting portions 214" arranged at opposite sides of a transversal base portion 211 thereof. Each mounting portion 214" defines a longitudinal slot 2143". Furthermore, there is key 2145" disposed at central of a bottom side of the longitudinal slot 2143".

Each clasping member 23" has a main body 231" located at a horizontal plane and two L-shaped locking arms 232" connected to opposite ends of the main body 231" and located in two vertical planes, and two feet 234" outwardly extending from bottom edges of the two L-shaped locking arms 232". There is positioning tab 233" bent upwardly from middle section of the main body 231" and disposed between the two locking arms 232'. Furthermore, there is a cutout 2321" defined in the locking arm 232". The clasping member 23" is inserted molded with the mounting portion 214", with the main body 213" supported by the mounting portion 214", the positioning tab 233" retained in the mounting portion 214", the two locking arms 232" received in opposite ends of the longitudinal slot 2143", and the two feet 234" exposed outward of the mounting portion 214".

When the first connector 100" mates with the second connector 200", the latching member 13" locking with the clasping member 23", with the main body 131" sandwiched between the two locking arms 232', the first protrusion 1331" of the connecting portion 133" pressed fit with the cutout 2321" of the corresponding locking arm 232". In addition, the depression 1311" aligns with the key 2145".

What is claimed is:

1. A connector assembly, comprising:

a first connector including a first insulative housing, a plurality of first terminals supported by the first insulative housing and at least one latching member combined with the first insulative housing, the first insulative housing having a transversal base portion and two mounting portions located at a right and left sides of the transversal base portion, and each mounting portion including a horizontal platform and two vertical protrusions supported by the horizontal platform, and a longitudinal slot defined on the horizontal platform and located between the two vertical protrusions, the latching member having two locking arms spaced apart from each other along a longitudinal direction;

a second connector including a second insulative housing, a plurality of second terminals supported by the second insulative housing and at least one clasping member combined with the second insulative housing, the clasping member having a rigid longitudinal bar with two free ends protruding at opposite directions; and wherein the rigid longitudinal bar is sandwiched between the two locking arms and the two free ends engaged with the two locking arms when the first connector mates with the second connector.

2. The connector assembly as claimed in claim 1, wherein the latching member includes a main body extending along a longitudinal direction and the latching arm connected with the main body.

3. The connector assembly as claimed in claim 2, wherein the latching arm is of L-shaped.

4. The connector assembly as claimed in claim 3, wherein the latching arm inwardly projects from the main body firstly and then upwardly projects.

5. The connector assembly as claimed in claim 1, wherein there is a hook formed at an end of each latching arm, and the hook engages with the corresponding free end of the longitudinal bar.

6. The connector assembly as claimed in claim 5, wherein the hooks of the two latching arms face to each other along the longitudinal direction.

7. The connector assembly as claimed in claim 1, wherein the latching arms are accommodated in the longitudinal slot and located adjacent to the two protrusions, respectively.

8. The connector assembly as claimed in claim 1, wherein the latching member is inserted molded with the corresponding mounting portion.

9. The connector assembly as claimed in claim 1, wherein the second insulative housing has a transversal base portion and two mounting portions formed at a right and left sides of the transversal base portion, and there are two cavities respectively located in a front and back sections of the mounting portion of the second insulative housing, and there is a longitudinal slot located in a middle segment of the mounting portion of the second insulative housing.

10. The connector assembly as claimed in claim 9, wherein the transversal bar is accommodated in the longitudinal slot and the free ends thereof extend into the two cavities, respectively.

11. A connector assembly, comprising:

a first connector including a first insulative housing, a plurality of first terminals supported by the first insulative housing and two latching members arranged at opposite sides of the first insulative housing, each latching member having a longitudinal main body, two horizontal feet disposed below the main body and extending along opposite directions and two connecting portions respectively linking the main body and the two horizontal feet, and each connecting portion having a protrusion projecting outwardly and another protrusion projecting inwardly and snapped into the first insulative housing;

a second connector including a second insulative housing, a plurality of second terminals supported by the second insulative housing and two clasping members arranged at opposite sides of the second insulative housing, each clasping member having two locking arms spaced apart from each other, and each locking arm defining a hole thereon;

wherein the longitudinal main body is sandwiched between the two locking arms and the protrusions pressed fit with the holes of the two locking arms when the first connector mates with the second connector.

12. The connector assembly as claimed in claim 11, wherein each first terminal has a first mating part and a second mating part, and each second terminal has a first mating segment and a second mating segment respectively contacting the first mating part and the second mating part.

13. The connector assembly as claimed in claim 12, wherein the first mating part and the second mating part both extend along a vertical direction and parallel to each other, and the first mating segment is S-shaped and the second mating segment is heart shaped.

14. The connector assembly as claimed in claim 13, wherein the first mating part has a free end projecting downwardly, and the second mating segment has an arc shaped distal end projecting inwardly.

15. An electrical board-to-board connector assembly comprising:

first and second connectors adapted to be mated with each other, the first connector including a first insulative elongated housing defining a longitudinal direction and a transverse direction thereof perpendicular to each other, and a first mating port with a pair of first retention sections at two opposite ends thereof along the longitudinal direction;

a plurality of first contacts disposed in the first housing along said longitudinal direction with first contacting sections exposed in the first mating port;

a pair of first retention devices disposed upon the corresponding first retention sections, respectively, each of said first retention devices including a first elongated bar extending along the transverse direction, and a pair of planar retention arms connecting directly with two opposite ends of the elongated bar and extending along the longitudinal direction and defining respective locking recesses facing inwardly to each other in the transverse direction;

the second connector including a second insulative elongated housing defined by said longitudinal and transverse directions and defining a second mating port with a pair of opposite second retention sections at two opposite ends thereof;

a plurality of second contacts disposed in the second housing along the longitudinal direction with second contacting sections exposed in the second mating port;

a pair of second retention devices disposed on the corresponding second retention sections, respectively, each of said second retention devices including a second elongated bar unitarily lying only in a vertical plane and extending along the transverse direction with two locking end structures spaced from and facing away from each other in said transverse direction and adapted to be outwardly engaged with the locking recesses of the corresponding retention arms, respectively when the first connector and the second connector are mated with each other.

16. The electrical board-to-board connector assembly as claimed in claim 15, wherein the retention arms and the corresponding first elongated bar are not aligned with each other in the transverse direction but offset from each other in the longitudinal direction while the locking end structures are aligned with the corresponding second elongated bar in the transverse direction.

17. The electrical board-to-board connector assembly as claimed in claim 15, wherein the first elongated bar is equipped with barb structures to secure the first elongated bar to the first housing.

* * * * *